US008047132B2

(12) United States Patent
Lu et al.

(10) Patent No.: US 8,047,132 B2
(45) Date of Patent: Nov. 1, 2011

(54) METHOD FOR AFFIXING A SEAL IMPRESSION ON A PAPER DOCUMENT AND HAND-HELD DEVICE USING THE SAME

(75) Inventors: Xin Lu, Shenzhen (CN); Shih-Fang Wong, Taipei Hsien (TW); Zai-An Pan, Shenzhen (CN); Bing Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 702 days.

(21) Appl. No.: 12/139,509

(22) Filed: Jun. 16, 2008

(65) Prior Publication Data

US 2008/0314265 A1 Dec. 25, 2008

(30) Foreign Application Priority Data

Jun. 22, 2007 (CN) ..... 2007 1 0200857

(51) Int. Cl.
*B41F 19/02* (2006.01)
*B44B 5/00* (2006.01)
*B31F 1/07* (2006.01)

(52) U.S. Cl. ..... 101/31.1; 101/18

(58) Field of Classification Search ..... 101/31.1, 101/18, 333, 334, 29, 22, 23, 28; 380/58; 346/22; 109/24.1
See application file for complete search history.

(56) References Cited

U.S. PATENT DOCUMENTS 3,833,795 A * 9/1974 Shoshani et al. ..... 101/72
4,852,478 A * 8/1989 Young et al. ..... 101/18
2005/0262201 A1* 11/2005 Rudolph et al. ..... 709/205

FOREIGN PATENT DOCUMENTS

FR 2733457 A3 * 10/1996

OTHER PUBLICATIONS

Intuit, Getting Started with Quicken Premier Home & Business (Copyright 2004).*

* cited by examiner

*Primary Examiner* — Leslie J Evanisko
*Assistant Examiner* — Blake A Tankersley
(74) *Attorney, Agent, or Firm* — Altis Law Group, Inc.

(57) ABSTRACT

A hand-held device and a method for affixing a seal impression on a paper document are provided. The hand-held device includes a processor, a memory unit, an input unit, and a seal impression generation unit for generating a seal impression. The processor generates a file code in response to a file code generation request and generates a control signal. The seal impression generation unit generates a seal impression according to the control signal of the processor. After the seal impression is affixed on a paper document, the processor generates a log file in response to a log file generation request.

4 Claims, 5 Drawing Sheets

METHOD FOR AFFIXING A SEAL IMPRESSION ON A PAPER DOCUMENT AND HAND-HELD DEVICE USING THE SAME

BACKGROUND

1. Technical Field

The present invention relates to a method for affixing a seal impression on a paper document and, in particular, to a hand-held device using the method for affixing a seal impression on a paper document.

2. General Background

People usually sign their names or affix a seal impression on a paper document to execute the paper document. However, a written signature or a seal on a paper document can be counterfeited.

In order to solve the problem mentioned above, an electronic signature method utilizing a portable communication device is introduced. The signature method uses a computer to store an electronic signature and uses a portable communication device to store a private key. When signing a file, a server sends a request to the portable communication device. If the portable communication device confirms the request, the server obtains files to be signed from the computer and transfers the obtained files to the portable communication device. The portable communication device receives the files and encrypts the files utilizing the private key. The portable communication device sends the encrypted files to the server. The server receives the encrypted files and signs the encrypted files via the electronic signature.

Although the electronic signature method mentioned could avoid the counterfeiting signature problem, some people are still in the habit of executing a paper document manually. Therefore, there is a need to provide a hand-held device to solve the aforementioned problems.

SUMMARY

A hand-held device and a method for affixing a seal impression on a paper document are provided. In an exemplary form, the hand-held device includes a processor, a memory unit, an input unit, and a seal impression generation unit for generating a seal impression. The processor generates a file code in response to a file code generation request and generates a control signal. The seal impression generation unit generates a seal impression according to the control signal of the processor. After the seal impression is affixed on a paper document, the processor generates a log file in response to a log file generation request.

The method for affixing a seal impression on a paper document using a hand-held device includes: generating a file code; generating a control signal according to the file code; generating a seal impression according to the control signal; and generating a log file.

Other novel features and advantages will be drawn from the following detailed description with reference to the attached drawings.

BRIEF DESCRIPTION OF THE DRAWINGS

The components of the drawings are not necessarily drawn to measuring scale, the emphasis instead being placed upon clearly illustrating the principles of the hand-held device. Moreover, in the drawings, like reference numerals designate corresponding parts throughout the several views.

DETAILED DESCRIPTION OF EMBODIMENTS

Figure 1:
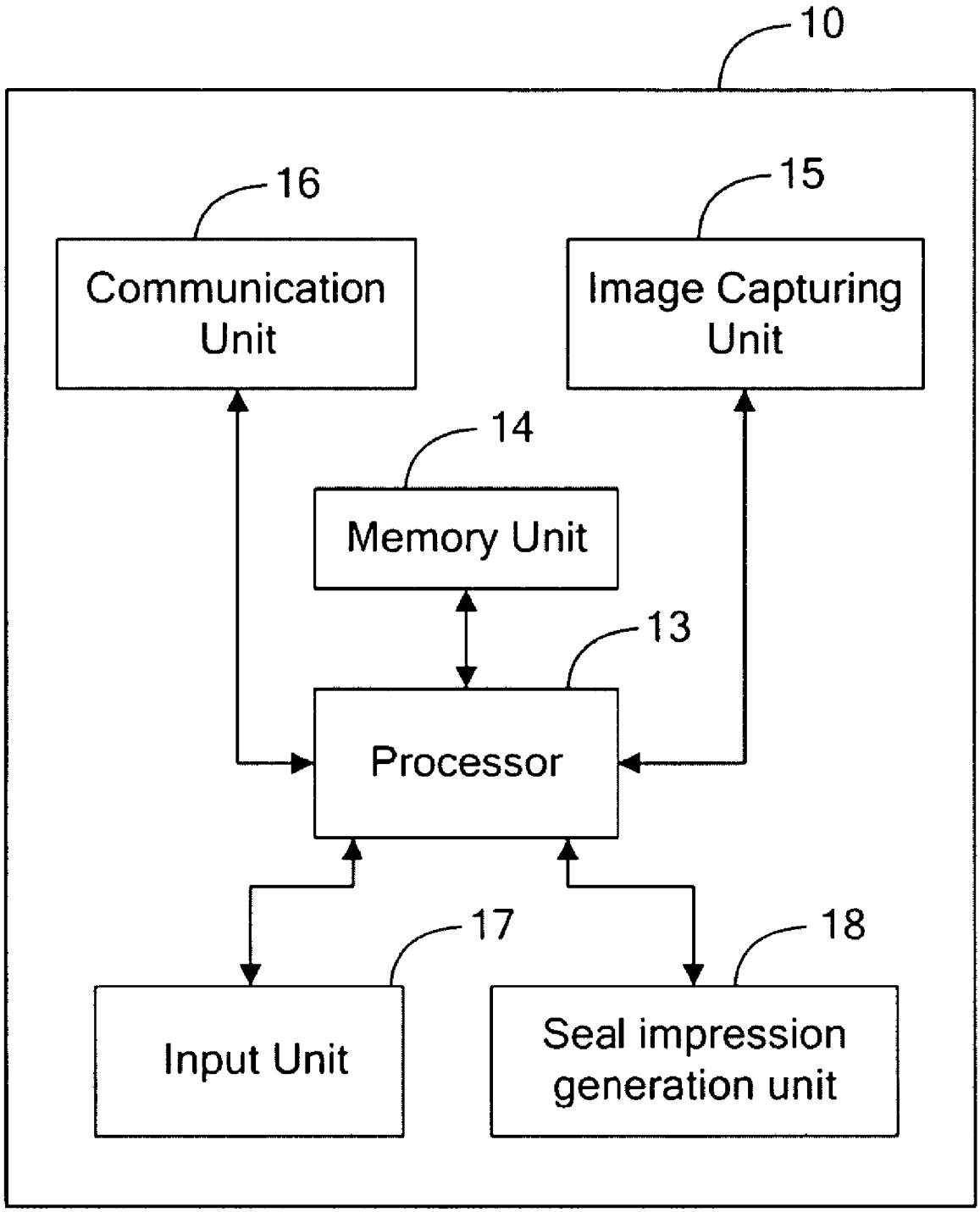
FIG. 1 is a block diagram of a hand-held device in accordance with one embodiment of the present invention.

FIG. 1 is a block diagram of a hand-held device in accordance with one embodiment of the present invention. The hand-held device 10 includes a processor 13, a memory unit 14, an image capturing unit 15, a communication unit 16, an input unit 17, and a seal impression generation unit 18.

The memory unit 14 can be any suitable storage medium, such as a combination of read-only memory and random access memory. The memory unit 14 stores a user profile which the processor 13 uses to verify valid users. The user profile may include information such as a user name and a corresponding user password.

The image capturing unit 15 can be a built-in camera and is used for capturing an image of a paper document. The communication unit 16 is used for connecting with a server to transfer data between the hand-held device 10 and the server, wirelessly or via a data line.

The input unit 17 is configured for receiving operational inputs to operate the portable communication device 10, such as an input for activating the image capturing unit 15, an input for initiating a file code generation request, and an input for initiating a log file generation request.

Figure 2:
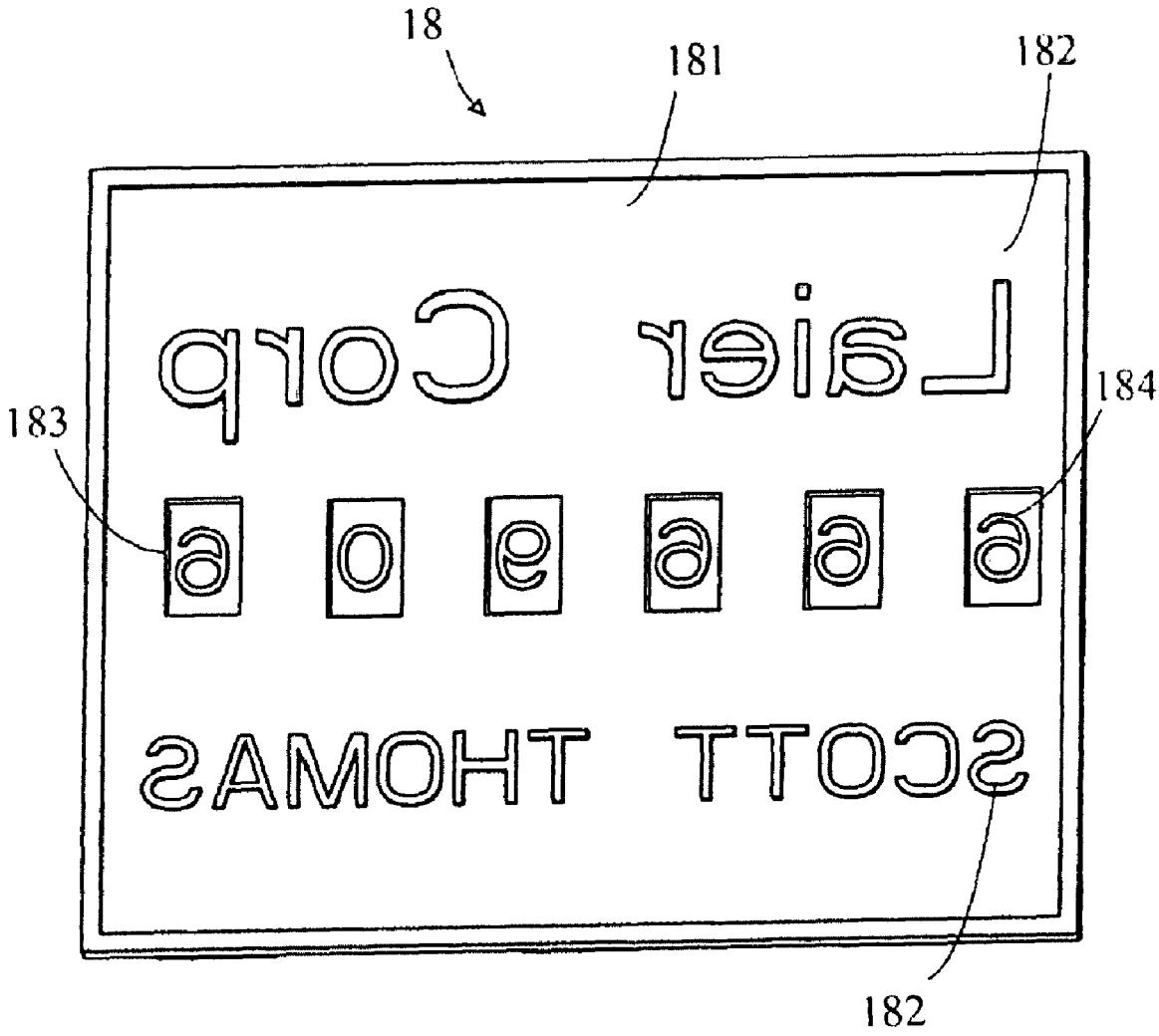
FIG. 2 is a schematic diagram of an engraved surface of a seal impression generation unit of the hand-held device of FIG. 1.

Referring to FIG. 2, the seal impression generation unit 18 includes an engraved surface 181. The engraved surface 181 includes engravings 182 protruding out of the engraved surface 181. Typically, the engravings 182 are mirror images of words, symbols, signs, figures, digits, or any combination of them. For example, in one embodiment as shown in FIG. 2, the engravings 182 are mirror images of "SCOTT THOMAS" and "Laier Corp", representing a user name and a company name respectively.

The engraved surface 181 further defines a plurality of openings 183 where a plurality of raised digits 184 are exposed correspondingly. In the embodiment as shown in FIG. 2, the plurality of openings 183 are defined linearly above the engravings 182, but in other embodiments, the plurality of openings 183 may be defined in other manners.

Figure 3:
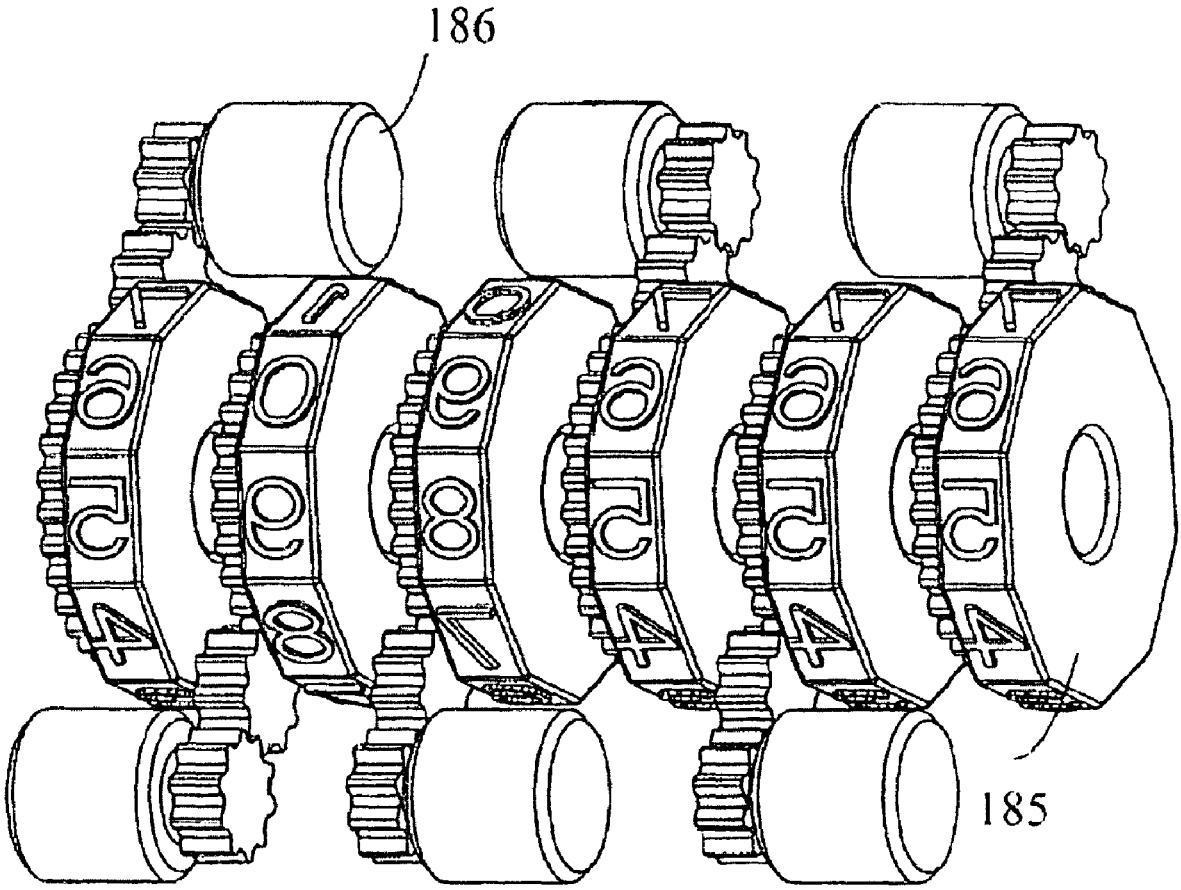
FIG. 3 is a schematic diagram of rotatable discs and motors of the seal impression generation unit of FIG. 2.
Figure 4:
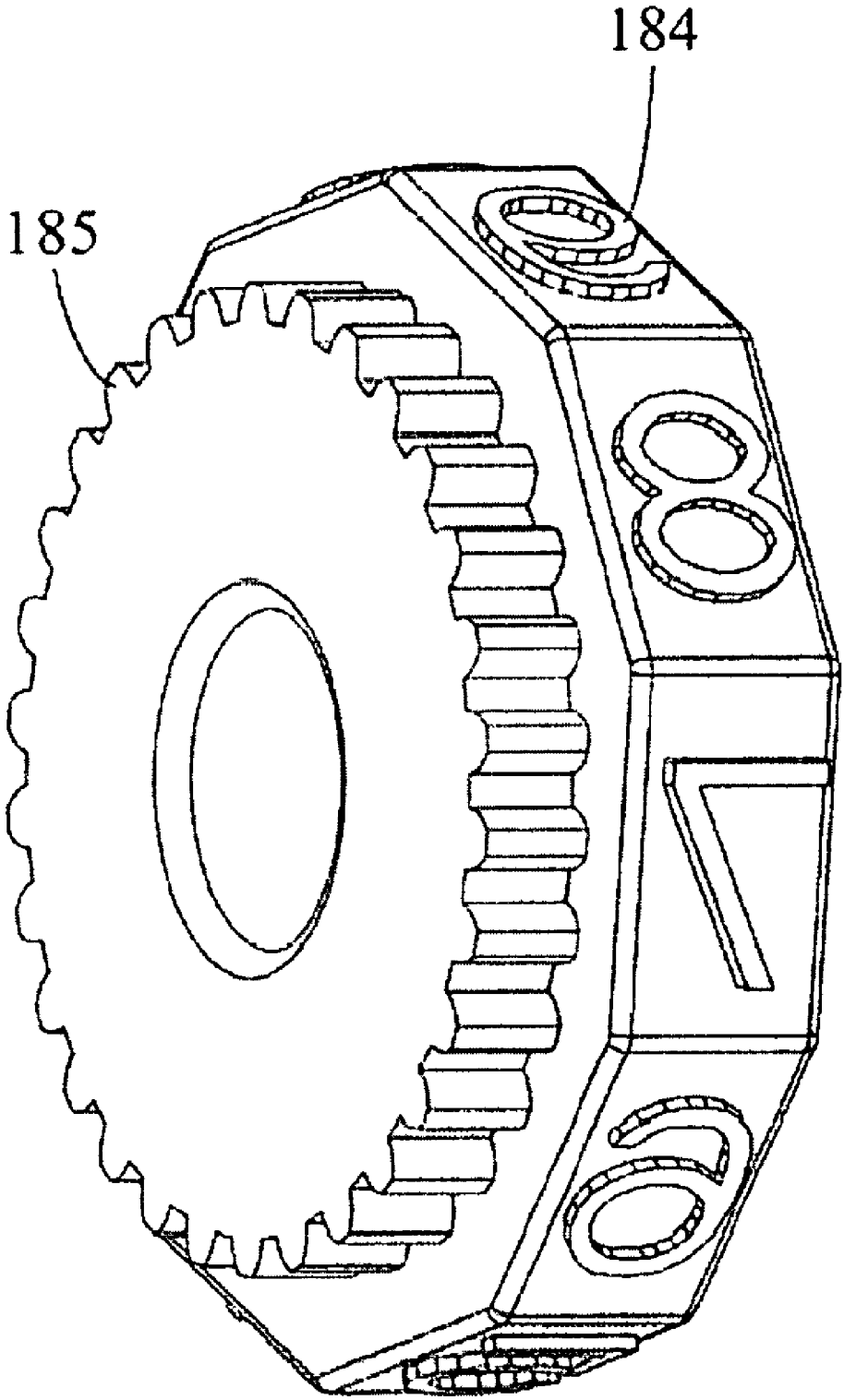
FIG. 4 is a schematic diagram of a rotatable disc of the seal impression generation unit of FIG. 2.

Also referring to FIG. 3, the seal impression generation unit 18 further includes a plurality of rotatable discs 185 and driving mechanism 186, such as motors behind the engraved surface 181, corresponding to the plurality of openings 183. Each of the motors 186 is configured for driving a corresponding disc 185. Each of the discs 185 has a plurality of raised mirrored digits 184 ranging from 0 to 9 on an outer circumferential surface.

The rotatable discs 185 and the motors 186 are disposed at a back surface of the seal impression generation unit 18 opposite to the engraved surface 181 in a manner such that the outer circumferential surface of the rotatable discs 185 slightly protrudes out of the openings 183, correspondingly exposing one of the raised digit 184 on the engraved surface 181.

After receiving the file code generation request from the input unit 17, the processor 13 generates randomly a unique file code. The file code may be a combination of digits, a combination of alphanumeric characters, or a combination of characters. The file code is stored in a predetermined folder in the memory unit 14 and is used for identifying a stamped paper document.

After generating the file code, the processor 13 generates a control signal according to the file code and sends the control signal to the seal impression generation unit 18. The motors 186 consequently drive each rotatable disc 185 to rotate to expose corresponding raised mirrored digits 184 through the openings 183, thus, a combination of raised mirrored digits 184 corresponding to the file code protrudes out of the openings 183. As a result, a seal impression, including the engravings 182 and the combination of raised mirrored digits 184 according to the file code, is formed on the engraved surface 181, thereby generating a seal impression.

After the seal impression is created, the engraved surface 181 of the seal impression generation unit 18 is applied ink, e.g. by pressing the generated seal impression on an inkpad, and then stamped on a paper document, thus a print of the generated seal impression is affixed on the paper document.

After the seal impression is affixed on the paper document, a digital image of the stamped paper document can be captured by the image capturing unit 15 under the control of the processor 13. The captured image of the paper document with the seal impression can be stored in the predetermined folder dedicated for storing the file code, thus correlating the file code and the stamped paper document.

A log file generation request can be generated via the input unit 14 after the paper document is stamped. After receiving a log file generation request, the processor 13 generates a log file. The log file includes the user name of the user profile, the date of receiving the log file generation request, the file code and the digital image stored in the predetermined folder. The user name is the name of a person with the authority to execute the paper document. The date of receiving the log file generation request represents the date of executing the paper document. The log file can be stored in the memory unit 14 or transferred to a server via the communication unit 16.

The combination of digits of the seal impression is unique because the file code is unique. If a seal impression on a paper document does not correspond with the seal impression in the digital image of a corresponding log file, the seal impression on the paper document is counterfeited.

Figure 5:
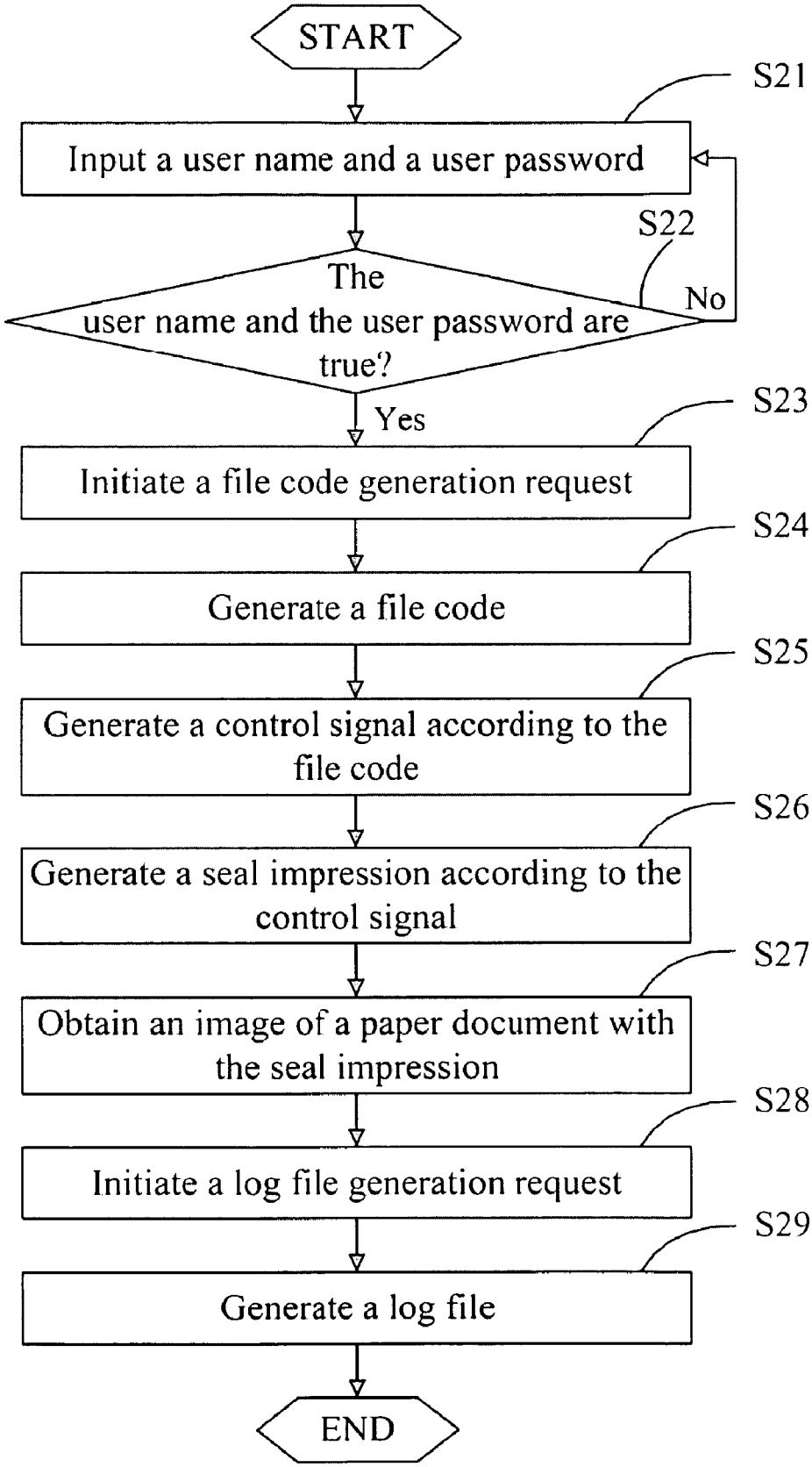
FIG. 5 is a flowchart of an exemplary method for affixing a seal impression on a paper document using the hand-held device of FIG. 1.

FIG. 5 is a flowchart of an exemplary method for affixing a seal impression on a paper document using the hand-held device 10 of FIG. 1.

In step S21, the user name and the user password are inputted through the input unit 17. In step S22, the processor 13 determines the validity of the combination of the user name and the user password. If the user name and the user password are not true, the procedure returns to step S21. If the user name and the user password are true, the procedure goes to step S23 in which the file code generation request are initiated thought the input unit 17.

In step S24, the processor 13 generates the file code in response to the file code generation request. In step S25, the processor 13 generates a control signal and sends the control signal to the seal impression generation unit 18.

In step S26, the seal impression generation unit 18 generates the combination of digits 184 which corresponds to the file code. As a result, the combination of digits 184 accompanying with the engravings 182 forms the seal impression.

In step S27, the image capturing unit is activated to obtain an image of the paper document with the seal impression generated by the seal impression generation unit 18.

In step S28, the log file generation request is initiated through the input unit 17. In step S29, the processor 13 generates a log file in response to the log file generation request.

Although the present invention has been specifically described on the basis of exemplary embodiments including an exemplary method, the invention is not to be construed as being limited thereto. Various changes or modifications may be made to the embodiment including the methods without departing from the scope and spirit of the invention.

What is claimed is:

1. A hand-held device for affixing a seal impression on a paper document, comprising:

a memory unit;

an input unit capable of receiving operational inputs to operate the hand-held device;

a seal impression generation unit capable of generating a seal impression; and a processor configured to randomly generate a file code for identifying the paper document in response to a first request from the input unit, to generate a control signal according to the file code to control the seal impression generation unit to generate a seal impression after the file code is generated, and to generate a log file in response to a second request from the input unit and store the log file on the memory unit.

2. The hand-held device according to claim 1, further comprising an image capturing unit, controlled by the processor, and capable of obtaining an image of the paper document.

3. The hand-held device according to claim 1, wherein the seal impression generation unit comprises an engraved surface, a plurality of rotatable discs, and a plurality of motors; wherein each of the discs has a plurality of engraved characters on an outer surface thereof, and the engraved surface defines a plurality of openings for the engraved characters to be exposed; and wherein each of the motors drives a corresponding rotatable disc to rotate to obtain a combination of the engraved characters protruding out of the openings in response to a control signal from the processor.

4. The hand-held device according to claim 3, wherein the engraved surface further comprises engravings representing a signature, the engravings together with the combination of characters cooperatively forming the seal impression.

* * * * *